US006572033B1

(12) United States Patent
Pullagura et al.

(10) Patent No.: US 6,572,033 B1
(45) Date of Patent: Jun. 3, 2003

(54) MODULE FOR DISPENSING CONTROLLED PATTERNS OF LIQUID MATERIAL AND A NOZZLE HAVING AN ASYMMETRIC LIQUID DISCHARGE ORIFICE

(75) Inventors: David Pullagura, Norcross, GA (US); Laurence B. Saidman, Duluth, GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/571,601

(22) Filed: May 15, 2000

(51) Int. Cl.[7] ..... B05B 7/10; B05B 1/00; B05B 1/26; A62C 31/02

(52) U.S. Cl. ..... 239/399; 239/599; 239/601; 239/596

(58) Field of Search ..... 239/399, 597, 239/598, 599, 601, 590.5, 592, 593, 594, 595, 596, 290, 296, 297, 1, 8, 11, 419.5; 222/533, 536, 568, 565

(56) References Cited

U.S. PATENT DOCUMENTS

| | | | | |
|---|---|---|---|---|
| 4,031,854 A | | 6/1977 | Sprague, Jr. | 118/641 |
| 4,135,903 A | | 1/1979 | Ohsato et al. | 65/5 |
| 4,185,981 A | | 1/1980 | Ohsato et al. | 65/5 |
| 4,844,003 A | | 7/1989 | Slautterback et al. | 118/323 |
| 5,171,512 A | | 12/1992 | Mende et al. | 264/555 |
| 5,267,693 A | * | 12/1993 | Dickey | 239/417.3 |
| 5,342,647 A | | 8/1994 | Heindel et al. | 427/2.31 |
| 5,553,758 A | * | 9/1996 | Melendy et al. | 222/533 |
| 5,645,220 A | * | 7/1997 | Hohndorf | 239/301 |
| 5,785,258 A | * | 7/1998 | Akin et al. | 239/590 |
| 5,882,573 A | | 3/1999 | Kwok et al. | 264/510 |
| 5,902,540 A | | 5/1999 | Kwok | 264/555 |
| 5,904,298 A | | 5/1999 | Kwok et al. | 239/135 |
| 5,921,476 A | * | 7/1999 | Akin et al. | 239/590 |
| 6,311,899 B1 | | 11/2001 | Hidaka et al. | 239/298 |

FOREIGN PATENT DOCUMENTS

| | | | |
|---|---|---|---|
| GB | 0792 744 A2 * | 3/1997 | B41J/2/14 |
| JP | 11244774 A | 9/1999 | |

OTHER PUBLICATIONS

Syang–Peng Rwei, *Dog–Legging in the Melt Spinning Process*, Polymer Engineering and Science, vol. 38, No. 2, pp. 341–347, Feb. 1998.

J&M Laboratories, *Durastitch™ Technology*, New Product Release Manual, Feb. 1997.

Rajiv S. Rao et al., *Vibration and Stability in the Melt Blowing Process*, Ind. Eng. Chem., 32, pp. 3100–3111, 1993.

* cited by examiner

*Primary Examiner*—Michael Mar
*Assistant Examiner*—Davis Hwu
(74) *Attorney, Agent, or Firm*—Wood, Herron & Evans, L.L.P.

(57) ABSTRACT

A module or dispenser for dispensing at least one liquid filament onto a moving substrate includes a nozzle body having a liquid supply port, a liquid discharge portion or end, and a liquid discharge passage having an orifice in fluid communication with the liquid supply port. The liquid discharge passage extends along an axis and the opening is shaped asymmetrically about the axis to provide a controlled directional movement of the liquid filament in a desired direction. The asymmetric shape may be formed by a notch or a chamfer or a stepped portion intersecting with the liquid discharge passage, or combinations of these features, or in other manners.

21 Claims, 5 Drawing Sheets

MODULE FOR DISPENSING CONTROLLED PATTERNS OF LIQUID MATERIAL AND A NOZZLE HAVING AN ASYMMETRIC LIQUID DISCHARGE ORIFICE

FIELD OF THE INVENTION

The present invention generally relates to a liquid material dispensing apparatus and, more specifically, to an applicator or module for dispensing controlled patterns of liquid filaments and a nozzle having a asymmetric liquid discharge orifice for controlling the direction in which the liquid filament is discharged.

BACKGROUND OF THE INVENTION

Many reasons exist for dispensing liquids, such as hot melt adhesives, in the form of a thin filament or strand with a controlled pattern. Conventional patterns used in the past include patterns involving a swirling effect of the filament by impacting filament with a plurality of jets of air. This is generally known as controlled fiberization or CFTυ in the hot melt adhesive dispensing industry. Controlled fiberization techniques are especially useful for accurately covering a wider region of a substrate with adhesive dispensed as single filaments or as multiple side-by-side filaments from nozzle orifices having small diameters, such as on the order of 0.010 inch to 0.060 inch. The width of the adhesive pattern placed on the substrate can be widened to many times the width of the adhesive filament itself. Moreover, controlled fiberization techniques are used to provide better control of the adhesive placement. This is especially useful at the edges of a substrate and on very narrow substrates, for example, such as on strands of material such as Lycra used in the leg bands of diapers. Other adhesive filament dispensing techniques and apparatus have been used for producing an oscillating pattern of adhesive on a substrate or, in other words, a stitching pattern in which the adhesive moves back-and-forth generally in a zig-zag form on the substrate.

Conventional swirl nozzles typically have a central adhesive dispensing orifice surrounded by a plurality of air orifices. The adhesive dispensing orifice is centrally located on a protrusion which is symmetrical in a full circle or radially about the adhesive dispensing orifice. Another advantageous controlled pattern dispenser, disclosed in U.S. patent application Ser. No. 09/571,703 filed on even date herewith and the disclosure of which is hereby incorporated herein by reference, locates the adhesive dispensing orifice on a wedge-shaped member and includes air orifices located in generally surrounding relation at the base of the wedge-shaped member.

One particular problem with conventional nozzles configured to produce a controlled pattern of adhesive by impacting the adhesive filament with air is that manufacturing imperfections or contaminates within the liquid adhesive discharge orifice may cause the discharging filament to be misdirected as the filament exits the discharge orifice. Since controlled fiberization techniques such as this are often utilized for applications requiring a high degree of accuracy, any unintended deflection of the adhesive filament upon discharge must be minimized. As a general illustration, FIGS. 1A and 1B schematically illustrate prior art swirled adhesive patterns 10*a,* 10*b,* 10*c* on a substrate 12 and a liquid discharge passage 20 of a nozzle 22 with a defect 24 shown in exaggerated form in FIG. 1B. This defect 24 causes the discharging filament 26 of adhesive to be deflected as shown in FIG. 1B. As shown in FIG. 1A, one result can be that adjacent patterns 10*a,* 10*b* of swirled adhesive filaments on a substrate, which are intended to be evenly spaced as shown in phantom lines, become unevenly spaced as shown in solid lines. FIG. 1C illustrates another problem of the prior art. In this figure a nozzle 21 is dispensing multiple strands or filaments of adhesive 26*a,* 26*b,* 26*c.* Liquid strands or filaments 26*a,* 26*b* are interfering with each other or tangling with each other as they exit nozzle 21 due, for example, to defect 24 shown in FIG. 1B. These occurrences can be undesirable or even intolerable for certain applications and are experienced in air assisted filament dispensing and non-assisted filament dispensing.

For the reasons stated above, as well as other reasons, it would be desirable to provide apparatus and methods which minimize or override the effect of manufacturing defects or other reasons for adhesive filaments to be deflected upon discharge and, therefore, to produce more controllable and predictable liquid adhesive filament patterns.

SUMMARY OF OF THE INVENTION

Generally, the present invention provides a liquid dispensing module including a dispenser or module body having a liquid supply passage. In the preferred embodiment, the liquid is hot melt adhesive, but the invention is applicable to other liquids as well, such as other polymeric thermoplastic liquids. A nozzle body is coupled to the module body and includes a liquid supply port, a liquid discharge portion or end and a liquid discharge passage having an orifice or opening in fluid communication with the liquid supply port. The liquid supply port is in fluid communication with the liquid supply passage of the module body. The liquid discharge passage of the nozzle body extends along an axis and the liquid discharge orifice has an asymmetric shape about the axis to provide a controlled directional movement of the liquid filament dispensed from the liquid discharge orifice.

In general, since the invention provides the above-mentioned controlled directional movement of the liquid filament upon discharge, this controlled movement overcomes potential deflections caused, for example, by manufacturing defects or contaminants within the discharge orifice itself or by other sources of unintended deflective movement of the filament. In the preferred embodiment, the substrate is moving beneath the dispenser or module and the controlled movement produced by the asymmetric shape of the orifice or opening at the discharge end is in the machine direction. As the liquid adhesive filament discharges from the orifice, the filament is purposely deflected in the machine direction. This helps prevent sideward deflection of a swirled adhesive pattern or other liquid filament pattern. In this manner, sideward spacing of adjacent patterns of adhesive is maintained as intended without tangling of adjacent patterns, or better edge control is achieved and, generally, more accurate positioning of the liquid is achieved side-to-side beneath the dispenser in a direction transverse to the substrate movement.

In various embodiments of the invention, the controlled movement of the discharged liquid filament and, more particularly, the asymmetric shape of the orifice, is achieved in different manners. As one feature, the notch intersects the liquid discharge passage and causes deflection of the adhesive in the direction of the notch. As another alternative, the discharge portion of the nozzle body may include a chamfer intersecting with the liquid discharge passage. As another alternative, the discharge portion may include a stepped portion intersecting with the liquid discharge passage.

These and other features, advantages and objectives of the invention will become more readily apparent to those of ordinary skill in the art upon review of the following detailed description of the preferred embodiments, taken in conjunction with the accompanying drawings.

DETAILED DESCRIPTION OF THE PREFERRED EMBODIMENTS

Figure 2:
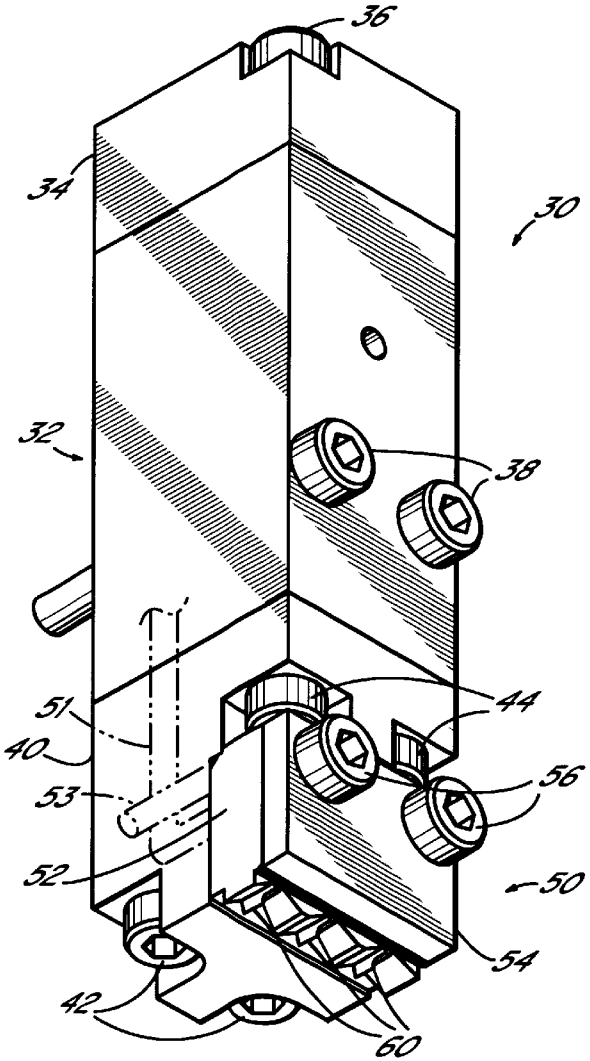
FIG. 2 is a perspective view illustrating a liquid adhesive dispenser or module having a nozzle constructed in accordance with one embodiment of the invention.

FIG. 2 generally illustrates a representative example of a dispenser module 30 usable in connection with this invention. It will be appreciated that many other alternative dispenser configurations may be used as well. Module 30 may, for example, be part no. 309637, which is sold by Nordson Corporation of Westlake, Ohio, and which is the assignee of the present invention. Dispenser module 30 includes a body 32 having an upper cap 34 secured to body 32 by fasteners 36 and including fasteners 38 which may be used to secure module 30 to a support, such as to adhesive and air manifold structures (not shown). A lower member 40 is secured to dispenser body 32 by fasteners 42, 44 and receives a nozzle assembly 50 constructed in accordance with the invention. Lower member 40 supplies a liquid, such as hot melt adhesive, as well as pressurized air to nozzle assembly 50 from respective liquid and air supply passages 51, 53. Nozzle assembly 50 generally includes a nozzle 52 and a cover plate 54. Cover plate 54 is secured to nozzle 52 by fasteners 56 and these fasteners 56 further couple nozzle 52 and cover plate 54 to lower member 40. As disclosed in more detail, for example, in U.S. Pat. No. 5,934,520, a valve within dispenser body 32 and lower member 40 selectively supplies adhesive to nozzle 52 in an on/off fashion. The disclosure of U.S. Pat. No. 5,934,520 is hereby fully incorporated by reference herein. The valve may be operated pneumatically or electrically, or through other mechanisms, the details of which are not necessary to a full understanding of the present invention. Nozzle 52 includes a plurality of adhesive filament discharge passages 60 with orifices or openings 60*a*. Three passages 60 are shown in FIG. 2, however, a greater or lesser number of dispensing passages 60 may be provided instead.

Figure 1A:
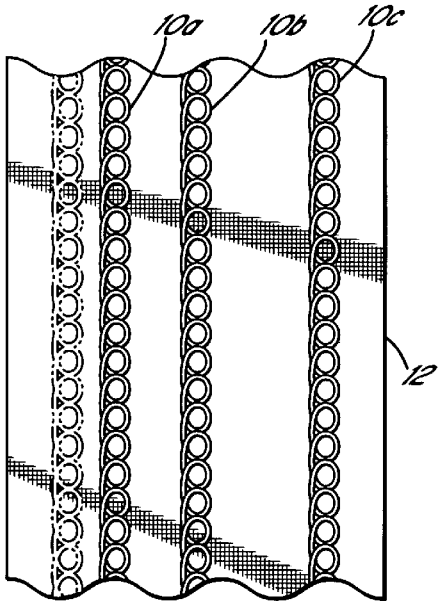
FIG. 1A PRIOR ART
FIG. 1A is an elevational view of swirled adhesive filament patterns illustrating problems of the prior art.
Figure 1B:
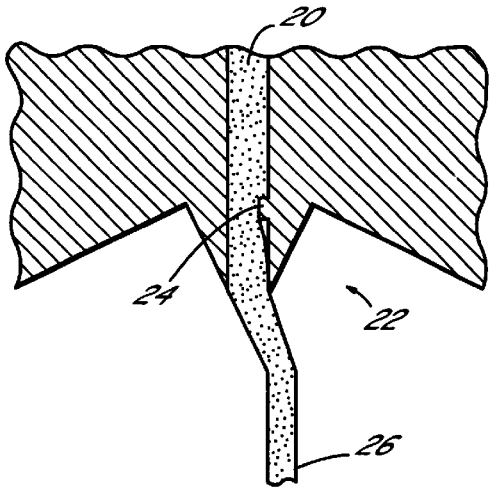
FIG. 1B PRIOR ART
FIG. 1B is a cross-sectional view of the discharge end of the nozzle shown in FIG. 1A illustrating in exaggerated form a manufacturing defect within the liquid discharge passage.
Figure 1C:
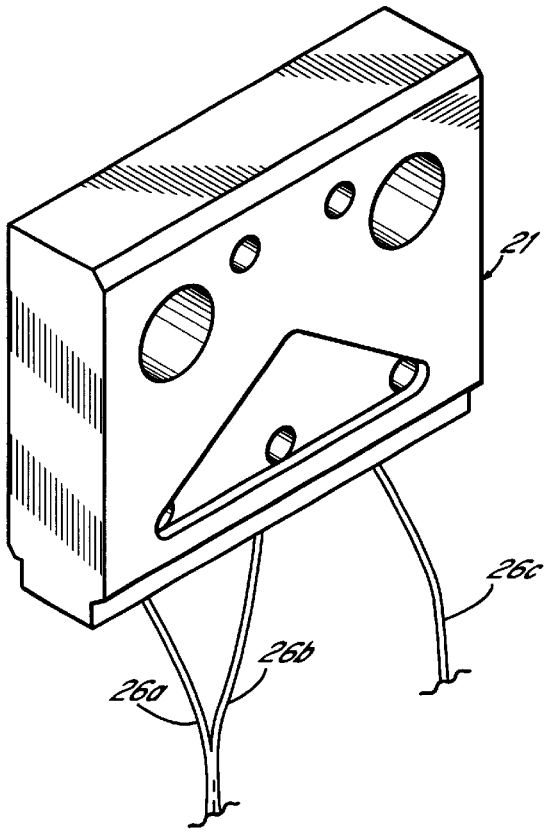
FIG. 1C PRIOR ART
FIG. 1C is a perspective view illustrating a filament tangling problem with the prior art.
Figure 3A:
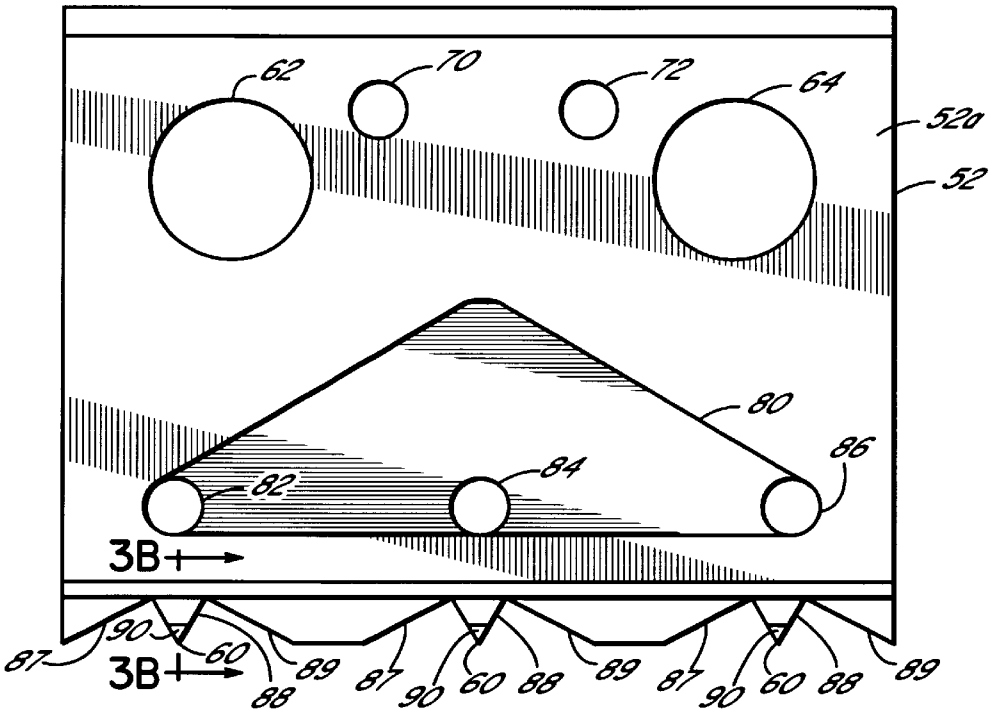
FIG. 3A is a rear elevational view of the nozzle shown in FIG. 2.
Figure 3B:
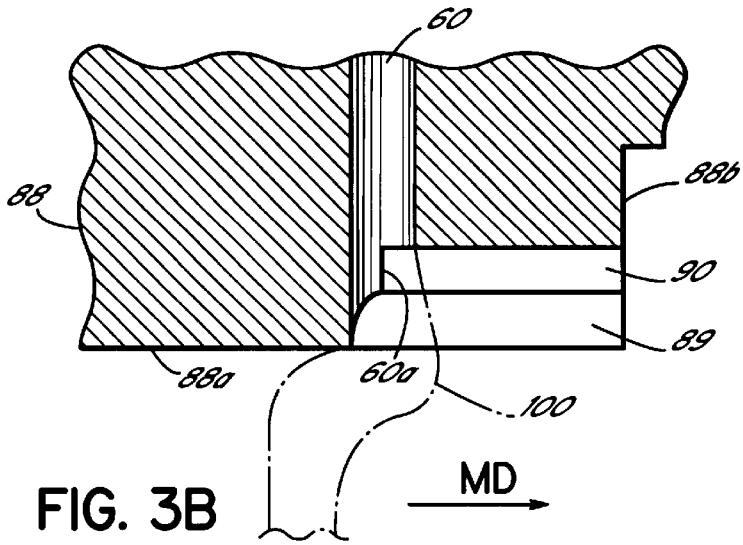
FIG. 3B is a cross-sectional view taken generally along line 3B—3B of FIG. 3A.

FIG. 3A illustrates the rear face 52*a* of nozzle 52 which faces lower member 40 of dispenser module 30 (FIG. 2). Holes 62, 64 receive fasteners 56 previously described with regard to FIG. 2. Holes 70, 72 comprise pressurized air supply ports which communicate with one or more pressurized air supply passages therein to deliver pattern air adjacent the discharged liquid filaments as discussed below. A recess 80 communicates with liquid supply ports 82, 84, 86 for supplying liquid hot melt adhesive to respective discharge passages 60. Discharge passages 60 are each formed in identical wedge-shaped members 88. Wedge-shaped members 88 are each positioned between a pair of angled surfaces 87, 89 which angle upwardly toward the base of each wedge-shaped 88 as shown in FIG. 3A. An exit at a peak or apex 88*a* thereof as shown in FIG. 3B. Apex 88*a* may be formed with a flat or may be relatively sharpened as shown in FIG. 3A.

As shown best in FIG. 3B, a flat or stepped portion 90 is formed starting at one end 88*b* of wedge-shaped member 88 and extending toward liquid discharge passage 60 until it intersects therewith. In this manner, the opening or orifice 60*a* of passage 60 at apex 88*a* is shaped in an asymmetric manner about the longitudinal axis of passage 60. A liquid adhesive filament 100 will exit discharge orifice 60*a* and upon exiting, will deflect in the direction of apex 88*a*, i.e., to the left as shown opposite to the machine direction MD. With nozzle 52 oriented as shown, apex 88*a* will ideally be aligned with the machine direction MD so that the deflection will occur in a direction parallel to the machine direction MD. It will be appreciated that machine direction MD may be in the exact opposite direction as well and that filament 100 may be discharged in other directions than vertically downward as shown.

Figure 3C:
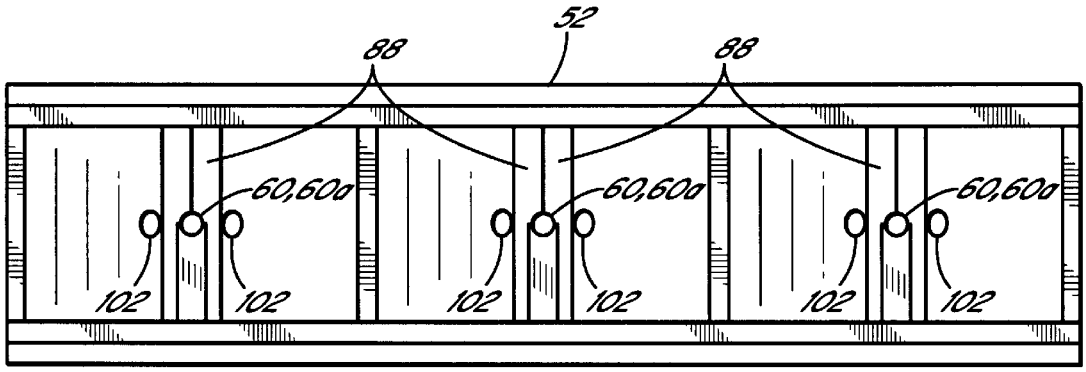
FIG. 3C is a bottom view of the nozzle illustrated in FIG. 3A.
Figure 3D:
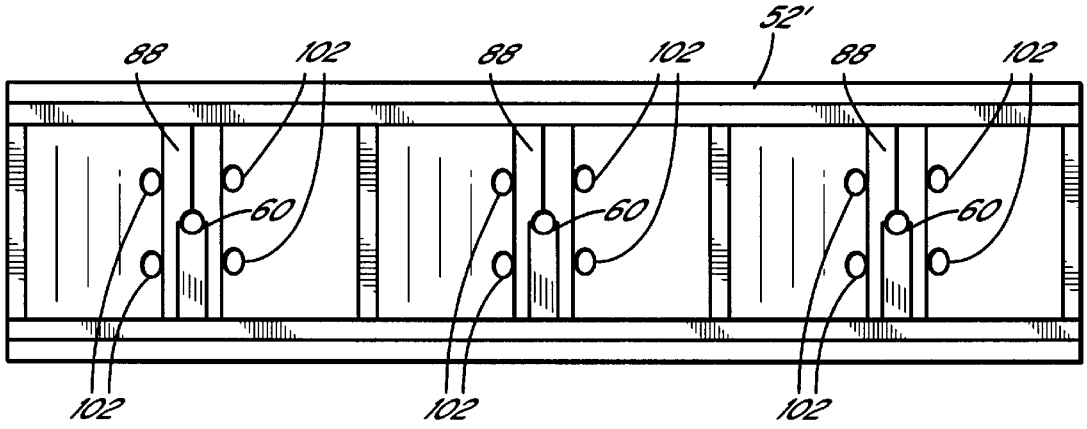
FIG. 3D is a bottom view similar to FIG. 3C, but illustrating an alternative air discharge orifice configuration.

FIG. 3D represents an alternative nozzle 52'. FIGS. 3C and 3D illustrate alternative configurations of respective liquid discharge passages 60 and air discharge orifices 102. Orifices 102 receive pattern air from ports 70, 72 (FIG. 3A) and discharge the air in streams toward a liquid filament exiting a respective orifice 60*a* to form a filament pattern, such as a swirl pattern. It will be appreciated that, for clarity, each of these orifices is illustrated with an exaggerated, enlarged diameter. In typical hot melt adhesive dispensing operations in which a swirling pattern of adhesive is desired, for example, the respective liquid discharge orifice sizes will range from 0.010 inch to 0.060 inch. The respective air discharge orifice diameters will also range from 0.010 inch to 0.060 inch. It will be appreciated that other liquid and air discharge orifice configurations and arrangements will be possible in accordance with the inventive concepts and, moreover, that the present invention is applicable to those applications that do not use air to deflect or otherwise control the pattern of adhesive discharging from the liquid discharge orifice.

Figure 4A:
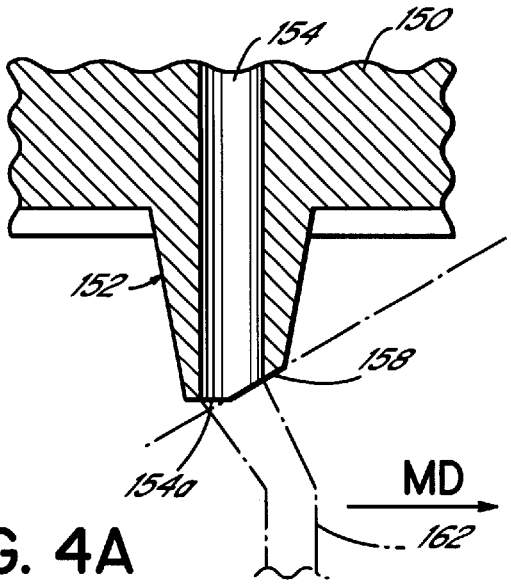
FIG. 4A is a cross-sectional view similar to FIG. 3B, but illustrating another alternative embodiment of the invention.
Figure 4B:
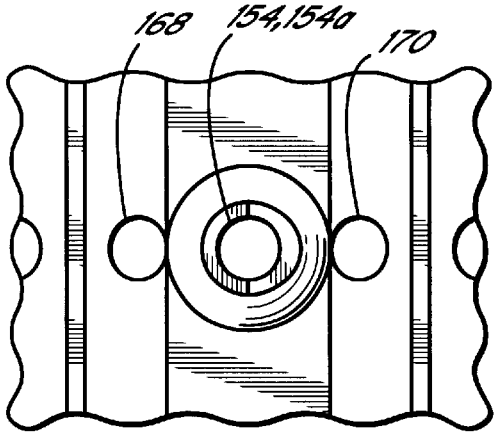
FIG. 4B is a bottom view of the nozzle shown in FIG. 4A.

FIGS. 4A and 4B illustrate another alternative nozzle 150 including a generally frustoconical-shaped projecting portion 152. A liquid discharge passage 154 having an orifice 154*a* extends centrally through projecting portion 152 along an axis. In accordance with the invention, a chamfer 158 is formed at the discharge end of liquid discharge passage 154 and projecting portion 152. This chamfer 158 preferably does not intersect with liquid discharge passage 154 for more than half the circumference thereof, as shown in FIG. 4B. In accordance with the general concepts of this invention, this forms a radially asymmetrical discharge opening 154*a* of passage 154. One side of passage 154 will therefore exit projecting portion 152 at a higher level, when oriented vertically as shown in FIG. 4A, than the opposite side of passage 154. It will be appreciated that other orientations are possible and will achieve similar objectives. Thus, a filament of liquid, such as hot melt adhesive 162, will immediately deflect upon exiting passage 154 in the direction of chamfer 158 and, when oriented as shown, in the machine direction MD. As further shown in FIG. 4B, air discharge orifices 168, 170 may be provided for forming a specific pattern of adhesive, such as a swirling pattern. For this purpose as well, additional air discharge orifices may be provided in generally surrounding relation to liquid discharge orifice 154*a*.

Figure 5A:
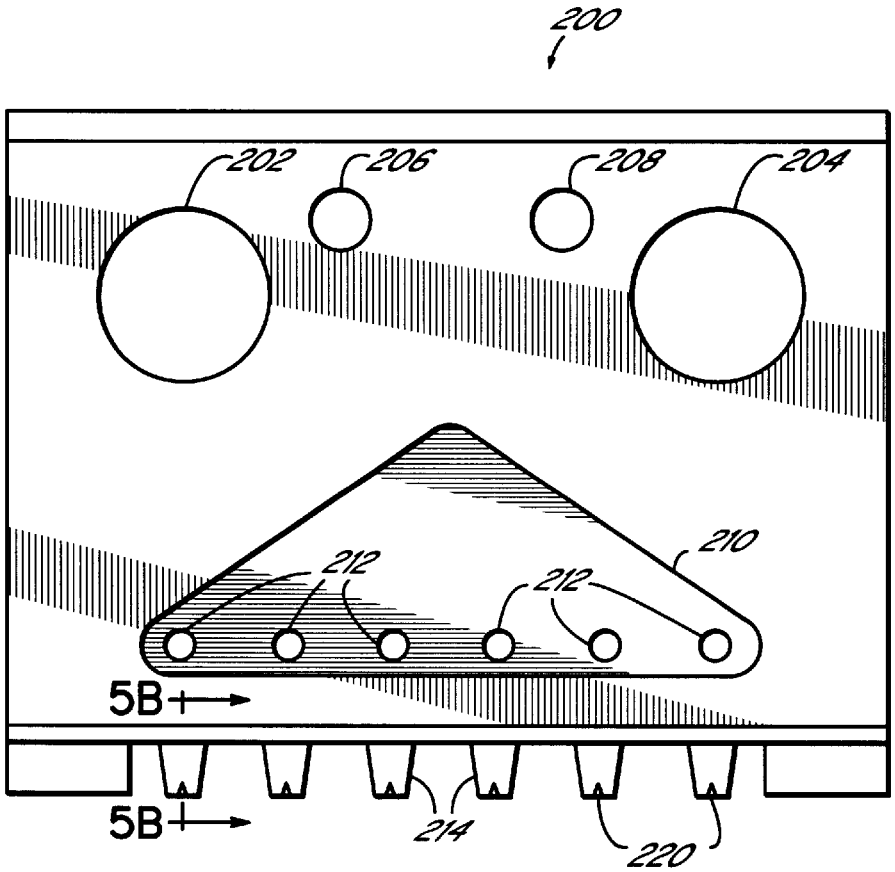
FIG. 5A is a rear elevational view of another alternative nozzle constructed in accordance with the invention.
Figure 5B:
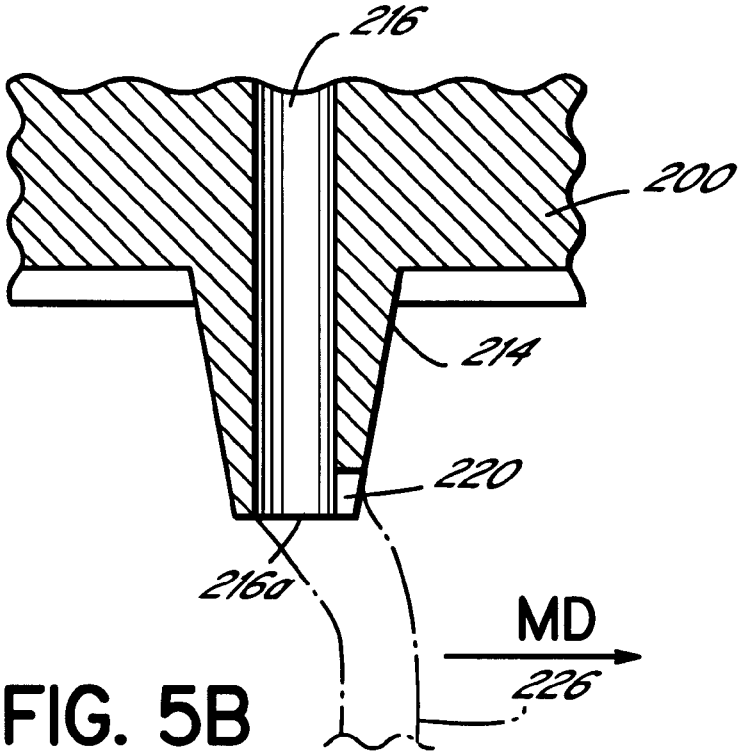
FIG. 5B is a cross-sectional view taken generally along line 5B—5B of FIG. 5A.

FIGS. 5A and 5B illustrate another alternative embodiment of a nozzle 200 constructed in accordance with the principles of the present invention. As with the first described embodiment, nozzle 200 may include fastener holes 202, 204, air supply ports 206, 208, and adhesive supply recess 210 and multiple adhesive supply ports 212, all similar to the embodiment described in FIG. 3A. Separate frustoconical projecting portions 214 extend from a lower surface of nozzle 200 and include liquid discharge passages 216 and respective openings or orifices 216*a*. A notch 220 is formed in each projecting portion 214 and intersects liquid discharge passage 216 as shown best in FIG. 5B. In a manner corresponding to the principles of the previous embodiments, this notch 220 causes a liquid filament 226 to deflect in the direction of notch 220 immediately upon exiting liquid discharge orifice 216*a*. Again, notch 220 is preferably oriented to face a direction parallel to the machine direction MD. When oriented as shown, this creates a higher exit point for filament 226 in a direction parallel to the machine direction MD and causes the intentional deflection as shown in FIG. 5B.

While the present invention has been illustrated by a description of various preferred embodiments and while these embodiments has been described in some detail, it is not the intention of the Applicants to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known. However, the invention itself should only be defined by the appended claims, wherein

We claim:

1. A module for dispensing at least one liquid filament onto a moving substrate, comprising:

a module body having a liquid supply passage;

a nozzle body having a liquid supply port in fluid communication with said liquid supply passage, a liquid discharge portion, a liquid discharge passage extending through said liquid discharge portion and being in fluid communication with said liquid supply port and having a liquid discharge orifice for dispensing the liquid filament; and said liquid discharge passage having an axis extending through a center of said liquid discharge orifice, said liquid discharge orifice of said liquid discharge passage having an asymmetric shape about said axis to control the direction of the liquid filament dispensed from said liquid discharge orifice.

2. The module of claim 1, wherein said liquid discharge portion includes a stepped portion intersecting with said liquid discharge passage to form said asymmetric shape of said liquid discharge orifice.

3. The module of claim 1, wherein said liquid discharge portion comprises a projecting portion having at least one side surface converging to an apex, said liquid discharge orifice extending through said apex.

4. The module of claim 3, wherein said projecting portion further comprises a wedge-shaped member, said wedge-shaped member having first and second planar side surfaces converging toward said apex.

5. The module of claim 1, wherein said nozzle body further includes a plurality of air discharge orifices positioned to discharge air at the liquid filament discharging from said liquid discharge orifice.

6. The module of claim 1 further comprising a plurality of said liquid discharge passages in said nozzle body each for discharging a respective liquid filament.

7. The module of claim 6, wherein said nozzle body further includes multiple sets of air discharge orifices positioned to discharge air at the respective liquid filaments.

8. The module of claim 6, wherein said asymmetric shapes of said liquid discharge orifices have deflecting portions oriented in the same direction.

9. A nozzle for dispensing at least one liquid filament onto a moving substrate, comprising:

a nozzle body having a supply port capable of receiving the liquid, a liquid discharge portion, a liquid discharge passage extending through said liquid discharge portion and being in fluid communication with said supply port and having a liquid discharge orifice for dispensing the liquid filament; and said liquid discharge passage having an axis extending through a center of said liquid discharge orifice, said liquid discharge orifice of said liquid discharge passage having an asymmetric shape about said axis to control the direction of the liquid filament dispensed from said liquid discharge orifice.

10. The nozzle of claim 9, wherein said liquid discharge portion includes a stepped portion intersecting with said liquid discharge passage to form said asymmetric shape of said liquid discharge orifice.

11. The nozzle of claim 9, wherein said liquid discharge portion comprises a projecting portion having at least one side surface converging to an apex, said liquid discharge orifice extending through said apex.

12. The nozzle of claim 11, wherein said projecting portion further comprises a wedge-shaped member, said wedge-shaped member having first and second planar side surfaces converging toward said apex.

13. The nozzle of claim 9, wherein said nozzle body further includes a plurality of air discharge orifices positioned to discharge air at the liquid filament discharging from said liquid discharge orifice.

14. The nozzle of claim 9, further comprising a plurality of said liquid discharge passages in said nozzle body each for discharging a respective liquid filament.

15. The nozzle of claim 14, wherein said nozzle body further includes multiple sets of air discharge orifices positioned to discharge air at the respective liquid filaments.

16. The nozzle of claim 14, wherein said asymmetric shapes of said liquid discharge orifices have deflecting portions oriented in the same direction.

17. A method of dispensing a filament of liquid onto a substrate from a nozzle having an orifice extending along an axis and including a discharge end with an edge surrounding the orifice, the edge having a liquid deflecting portion recessed in a direction opposite to the direction of flow through the orifice, the method comprising, placing the substrate adjacent the discharge end of the orifice, moving the substrate relative to the nozzle along a direction, orienting the liquid deflecting portion in a direction parallel to the direction in which the substrate is moving, discharging the liquid from the discharge end of the orifice as a filament, and deflecting the filament with the liquid deflecting portion in a direction parallel to the direction in which the substrate is moving.

18. The method of claim 17, further comprising:

discharging multiple streams of air at the liquid filament to form a pattern on the substrate.

19. The method of claim 18, wherein the pattern is a swirled pattern.

20. A module for dispensing at least one liquid filament onto a moving substrate, comprising:

a module body having a liquid supply passage;

a nozzle body having a liquid supply port in fluid communication with said liquid supply passage, a liquid discharge portion, a liquid discharge passage extending through said liquid discharge portion and being in fluid communication with said liquid supply port and having a liquid discharge orifice for dispensing the liquid filament;

wherein said liquid discharge passage extending along an axis and said liquid discharge orifice of said liquid discharge passage having an asymmetric shape about said axis to control the direction of the liquid filament dispensed from said liquid discharge orifice;

wherein said liquid discharge portion comprises a projecting portion having at least one side surface converging to an apex, said liquid discharge orifice extending through said apex; and wherein said projecting portion further comprises a wedge-shaped member, said wedge-shaped member having first and second planar side surfaces converging toward said apex.

21. A nozzle for dispensing at least one liquid filament onto a moving substrate, comprising:

a nozzle body having a supply port capable of receiving the liquid, a liquid discharge portion, a liquid discharge passage extending through said liquid discharge portion and being in fluid communication with said supply port and having a liquid discharge orifice for dispensing the liquid filament;

said liquid discharge passage extending along an axis and said liquid discharge orifice of said liquid discharge passage having an asymmetric shape about said axis to control the direction of the liquid filament dispensed from said liquid discharge orifice;

wherein said liquid discharge portion comprises a projecting portion having at least one side surface converging to an apex, said liquid discharge orifice extending through said apex; and wherein said projecting portion further comprises a wedge-shaped member, said wedge-shaped member having first and second planar side surfaces converging toward said apex.

* * * * *